United States Patent [19]

Warncke

[11] Patent Number: 4,508,115

[45] Date of Patent: Apr. 2, 1985

[54] PROTECTIVE BREATHING HOOD FOR ESCAPE PURPOSES

[75] Inventor: Ernst Warncke, Lübeck, Fed. Rep. of Germany

[73] Assignee: Drägerwerk AG, Fed. Rep. of Germany

[21] Appl. No.: 479,567

[22] Filed: Mar. 28, 1983

[30] Foreign Application Priority Data

May 29, 1982 [DE] Fed. Rep. of Germany ..... 3220458

[51] Int. Cl.[3] ..... A62B 7/00

[52] U.S. Cl. ..... 128/201.23; 128/201.28; 2/171.3

[58] Field of Search ..... 128/201.22, 201.23, 128/201.24, 201.25, 201.28, 201.29, 202.14; 2/2, 410, 5, 6, 7, 171.3, DIG. 3, DIG. 10, DIG. 1

[56] References Cited

U.S. PATENT DOCUMENTS 3,068,865 12/1962 Laszlo ..... 128/200.28
3,123,831 3/1964 Wells et al. ..... 128/201.23
3,310,811 3/1967 Iacono, Jr. ..... 128/201.24
4,231,359 11/1980 Martin ..... 128/201.23

*Primary Examiner*—Henry J. Recla
*Attorney, Agent, or Firm*—McGlew and Tuttle

[57] ABSTRACT

In many instances, particularly in mining underground, sudden gas outbursts (of methane, $CO_2$) make it necessary for workers to have recourse to respiratory protection within seconds. Taking for granted that under such circumstances protective helmets are worn too, it is provided to combine a helmet with a protective breathing hood. At standby, the hood is carried in folded state in a closed space formed at a bent-out rim portion of the helmet. The hood is connected to a breathing gas supply. Upon opening the supply, the breathing gas flows into double-walled portions of the hood and causes unfolding or unrolling, i.e. stretching of the hood, thus dropping from the helmet around the user's head downwardly. The breathing gas continues to flow into the interior of the hood.

13 Claims, 3 Drawing Figures

PROTECTIVE BREATHING HOOD FOR ESCAPE PURPOSES

FIELD AND BACKGROUND OF THE INVENTION

This invention relates in general to breathing devices and in particular to a new and useful protective helmet and hood for persons operating in emergency situations.

Protective breathing hoods combined with a breathing gas supply are known in most various designs. In emergency, however, they all have the common drawback that at the occurrence of a dangerous situation they must first be put in a complicated manner and then set into operation.

Particularly in mining operations underground, sudden outbursts of gas (methane, $CO_2$) may make it necessary to start a breathing protection instantly, within seconds, since the forming ambient atmosphere may completely displace oxygen. Failing to establish a protection, any escape may be frustrated since unconsciousness follows within a few breaths.

The inventive idea can take for granted the assumption that at such hazardous locations, both in the mining and in other industries, protective helmets are worn as a rule.

In the prior art, a protective breathing hood is known which is used in combination with a protective helmet. The hood comprises a jacket-type tubular part, of fabric for example, having a window and being gathered at its upper rim. This tubular jacket is engaged over the helmet and carried by the rim thereof. Air is supplied therein through a connection passed through the front portion of the helmet rim. Two flexible tubes resting each at one side against the gathered rim of the hood lead from the connection to a T-fitting to which compressed air is supplied through another flexible tube. The hood has the disadvantage already mentioned above that in an emergency situation, it must first be put on and then made ready for use (German utility model No. 1863467)

SUMMARY OF THE INVENTION

The invention is directed to a protective breathing hood for escape purposes, which is at hand together with a protective helmet and in emergency can be slipped or dropped into position of use instantly, without removing the helmet.

In accordance with the invention, a protective helmet comprises a helmet body which has a head encompassing the helmet portion with an annular brim having a downwardly extending skirt portion. An annular hood has an upper end which is connected to the helmet portion and is foldable into the space below the brim and within the skirt portion. The hood is extendable downwardly to enclose the space between the wearer's face and his shoulders. In one embodiment, the hood is made of double wall construction and it is connected through a tube to a pressurized container of a breathing gas such as oxygen. When the gas is supplied to the double wall of the hood, it causes the walls to expand and the hood to release and unfold so that it falls downwardly over and around the face of the wearer. The lower end of the hood is advantageously formed with a conduit formation in a lowermost fold of the hood so that a drawstring may be positioned in the conduit and permit the hood to be tightened around the wearer's neck is desired. In another embodiment of the invention, the hood is provided with emergency storage of a gas such as oxygen within a tubular formation directly below the brim of the hat which, for example is connected into the double walls of the hood or directly into the space between the hood and the wearer's face.

The folded hood is advantageously retained in place below the brim of the helmet by means of a ring cover which is advantageously made of a multiple number of parts so that it may be easily dislodged from its position engaged with the rim of the helmet when the mask is to be positioned in a ready position extending downwardly below the wearer's face.

At the rim of the helmet, the hood is accommodated in a minimum space, and is safely protected itself against damaging material influence from the outside. In emergency, by admitting a stored breathing gas, the folded or rolled hood deploys automatically and establishes the needed protection within seconds. The helmet together with the hood form a complete enclosure around the user's head and thus screen the respiratory tract which is instantly supplied with the breathing gas flowing in.

For extended periods of use, such as with long escapeways, it is advisable to store the breathing gas in a bottle and supply it through a line; if brief periods of use are expected a storage in a circular nest of tubes provided directly at the helmet may be preferable.

A conduit provided at the lower end of the hood and accommodating an inserted drawstring with which the hood can be gathered to apply against the user's neck, provides in a simple way a still better isolation from the ambient atmosphere.

Altogether, the inventive protective emergency hood substantially contributes to enlarging the assortment of devices needed for ensuring safe working conditions.

Accordingly, it is an object of the invention to provide an improved helmet which includes a hood stored at the brim of the helmet in a folded condition and which may be extended downwardly over the wearer's face.

A further object of the invention is to provide a protective helmet which includes a hood which is extendable down over a wearer's face and which includes means for supplying a breathing gas to the space enclosed by the hood in the helmet and which advantageously is connected into a double wall formation of the hood so that the hood is automatically extended when the breathing gas is connected is connected to the hood.

A further object of the invention is to provide a protective helmet and hood construction which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
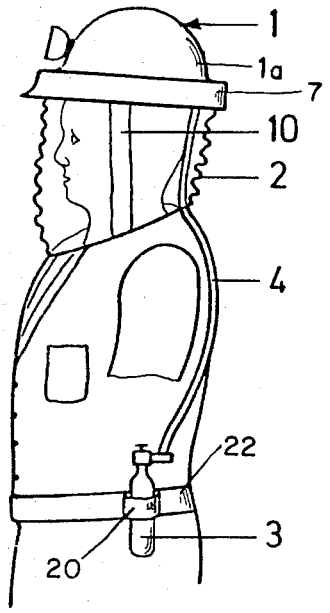
FIG. 1 is a schematic side elevational view showing a person wearing a helmet and protective hood constructed in accordance with the invention.
Figure 2:
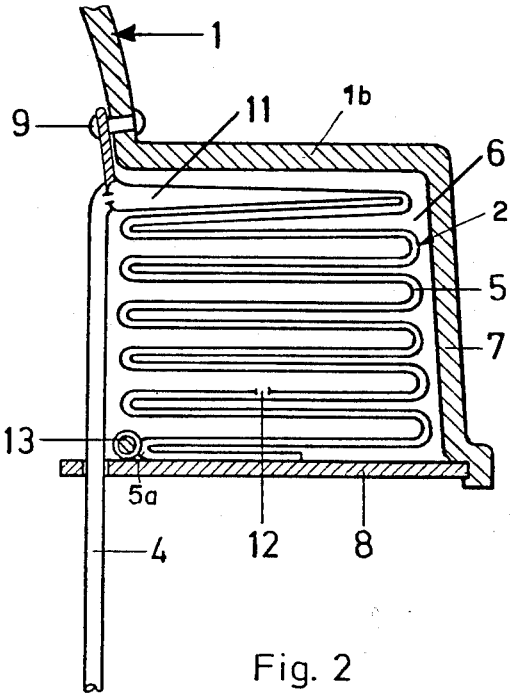
FIG. 2 is an enlarged sectional view of the brim portion of the helmet shown in FIG. 1 indicating the hood portion in a stored position.

Referring to the drawings in particular the invention embodied therein in FIGS. 1 and 2 comprises a protective helmet 1 which includes a head encompassing helmet portion 1*a* with an annular brim 1*b* having a downwardly extending skirt portion 7. In accordance with the invention an annular hood 2 is connected at its upper end by means of a fastener 9 to the helmet portion 1*a*. The hood 2 is made with pleats or folds so that it is foldable within the space 6 below the brim 1*b* and within the rim 7. The hood 2 is extendable from the position shown in FIG. 2 to the ready position shown in FIG. 1. In the extended position the hood 2 encloses the space between the wearer's face and his shoulders.

In the embodiment of the invention shown in FIG. 1, the hood 2 is advantageously made of double wall construction with the folds or pleats 5 and with a tubular portion or conduit forming portion connected to the lowermost fold 5*a* and carrying a drawstring 13 which permits the hood to be tightened adjacent the neck of the wearer. The folded hood 2 is advantageously retained in the space 6 by means of a ring shaped cover 8 which is made of a plurality of parts which may be dislodged from a engagement with the rim portion 7 upon supplying of breathing gas such as oxygen from a pressurized supply 3 which is worn on a holder 20 to the wearer's belt 22. The gas is admitted into a space 11 formed directly onto the brim 1*b* and which is connected to the hood to the space between the walls thereof. This gas is admitted from the double walled space between the walls of the hood 2 into the space surrounding the wearer's face to one or more openings 12 defined in the inner wall of the hood 2.

Figure 3:
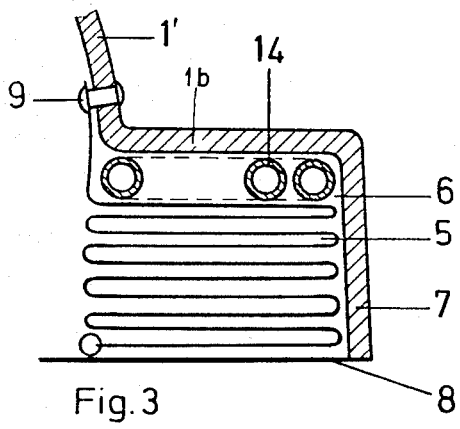
FIG. 3 is a view similar to FIG. 2 of another embodiment of the invention.

In the embodiment shown in FIG. 3, instead of a separate storage container 3, the breathing gas may be stored in the tubular formation 14 formed directly beneath the brim 1*b* of a helmet 1'.

FIG. 1 illustrates an emergency situation during which the user's head is protected and isolated from the ambient atmosphere both by a helmet 1 and a protective breathing hood 2. A breathing gas supply is provided in a bottle 3 carried on the belt and connected to the hood by a line 4.

FIGS. 2 and 3, show specific designs of how protective breathing hood 1 may be held in a standby position, namely accommodated in folded state 5 in a minimum space 6 at a bent-out rim or skirt portion 7 of the helmet 1, while being supported by a multi-part retaining ring or support 8. Hood 2 is made of a flexible material which is transparent, at least within the vision range. Through connections 9, the hood is directly suspended from an upper portion 1*a* of the protective helmet 1.

As shown in FIG. 2, line 4 is introduced at the upper end of the hood into a double walled space 11 formed within at least a portion 10 of the skirt portion 7. The breathing gas flowing in deploys hood 2 by stretching it downwardly, whereby retaining ring 8 is knocked out, and openings 12 provided in the inside wall of the hood are exposed, so that the gas can flow into the interior of the extended hood in the space surrounding the wearer's face. The lowermost one 5*a* of the folds 5 of the hood terminates in a conduit for an inserted drawstring 13. The string makes it possible to gather the hood at the lower end thereof toward the user's neck, and thus better separate the inside from the ambience.

In the embodiment of FIG. 3, which may be provided for shorttime use, the supply of breathing gas is stored in a circular nest of interconnected tubes 14.

While specific embodiments of the invention have been shown and described in detail to illustrate the application of the principles of the invention, it will be understood that the invention may be embodied otherwise without departing from such principles.

What is claimed is:

1. A protective breathing hood for escape purposes, comprising a head covering helmet having a periphery and an annular brim, extending laterally from said helmet periphery and terminating in an annular periphery a skirt portion extending downwardly from the annular periphery of said brim, an annular hood having an upper end connected to said helmet adjacent said helmet periphery and a remaining portion folded within the confines of said brim and said skirt portion around the wearer's head and below said brim, an annular cover disposed beneath and supporting said hood, and detachably connected to said skirt portion and means associated with said helmet hood to remove said cover and extend said hood downwardly to encircle the head of the wearer.

2. A protective helmet according to claim 1, including a breathing gas storage connected into the space between said hood and the wearer's face.

3. A protective helmet according to claim 1, wherein said hood is of double wall construction, and including a breathing gas connection into the space between the walls of said double wall hood construction.

4. A protective helmet according to claim 3, including cover means enclosing the space below said brim and holding said hood within the space, said cover being removable on supplying gas to said hood.

5. A protective helmet according to claim 1, wherein said protective hood comprises at least a portion of being of double walled formation and including a breathing gas supply connected into the double walled formation so as to stretch the hood to cause the fold thereof to expand outwardly and release the hood downwardly around the wearer's face.

6. A protective helmet according to claim 1, wherein said hood is formed so that it may be folded into a narrow compact state.

7. A protective helmet according to claim 1, wherein said hood is formed so that it may be rolled into the space below said brim.

8. A protective helmet according to claim 1, including a breathing gas tank adapted to be worn by a wearer, said helmet including a means defining a space below said brim connected to said pressure gas tank, said hood being of double walled construction and being connected to said double walled space.

9. A protective helmet according to claim 1, including a belt engageable with the wearer, a pressure gas supply carried on the wearer's belt and a conduit connected from said pressure gas supply to said helmet for supplying the gas to the space between said hood and the wearer's face.

10. A protective helmet according to claim 1, including a tubular formation disposed beneath said brim and including a pressure gas supply connected to said tubular formation.

11. A protective belmet according to claim 1, including a drawstring connected to the lower end of said hood for tightening said hood around the wearer's neck.

12. A protective helmet comprising a helmet body having a head encompassing helmet portion having a periphery and an annular brim extending laterally from said helmet periphery and terminating in an annular periphery, a downwardly extending skirt portion extending downwardly from the annular periphery of said brim, an annular hood having an upper end connected to said helmet portion above and adjacent to said helmet portion periphery and a head covering portion being foldable into the space below said brim and within said skirt portion and extending downwardly to close the space between the wearer's face and shoulders, said hood being of double wall construction having an inner wall with openings therein and a breathing gas supply connected to the upper end of said hood into the space between the double walls providing a flow of breathing gas to the annular hood which effects the unfolding thereof and its downward extension to close the space between the wearer's face and the shoulders, the breathing gas being flowable through the space between the walls of said hood and exiting out the opening of the inner walls thereof into the space between said hood and the wearer's face.

13. A protective helmet according to claim 12, wherein said hood has a lower end, an including a drawstring connected to said lower end of said hood for tightening said hood around the wearer's neck.

* * * * *